US005170019A

United States Patent [19]

Lee

[11] Patent Number: 5,170,019

[45] Date of Patent: Dec. 8, 1992

[54] SOUND MUFFLING DEVICE FOR INTERNAL COMBUSTION ENGINES

[76] Inventor: Jung W. Lee, 7305 Foxe Pl., Springfield, Va. 22151

[21] Appl. No.: 735,812

[22] Filed: Jul. 25, 1991

[51] Int. Cl.[5] ..... F01N 1/06

[52] U.S. Cl. ..... 181/204; 181/222; 181/225; 181/229; 181/258; 181/265; 181/268; 181/282

[58] Field of Search ..... 181/202, 204, 222, 225, 181/227, 228, 229, 238, 251, 252, 256, 257, 258, 264, 265, 266, 268, 272, 275, 282

[56] References Cited

U.S. PATENT DOCUMENTS 3,461,683 8/1969 Valbjorn et al. ..... 55/276
3,656,576 4/1972 Gubela ..... 181/290
4,032,310 6/1977 Ignoffo ..... 55/276
4,050,913 9/1977 Roach ..... 55/276
4,111,081 9/1978 Hilliard et al. ..... 181/290
4,616,732 10/1986 Carboni ..... 181/225 X
4,643,271 2/1987 Coburn ..... 181/210
5,062,790 11/1991 Loberger et al. ..... 181/229 X

*Primary Examiner*—Michael L. Gellner
*Assistant Examiner*—Khanh Dang
*Attorney, Agent, or Firm*—Birch, Stewart, Kolasch & Birch

[57] ABSTRACT

A sound muffling device for use in lawnmowers includes a hollow body containing an aperture plate, a plurality of serpentine configured pipes, a plurality of fans, a double net having a bundle of wires, and a microporous plate, an adaptor having a sound inlet disposed on the exterior of the front end of the hollow body, and a sound outlet of the exterior of a rear end of the hollow body.

6 Claims, 2 Drawing Sheets

SOUND MUFFLING DEVICE FOR INTERNAL COMBUSTION ENGINES

BACKGROUND OF THE INVENTION

1. Field of the Invention

The present invention relates to a sound muffling device for and more particularly, to a sound absorbing device for a lawnmower, including a banana shaped housing containing sound muffling means, an adaptor having a sound inlet, and a sound outlet.

2. Description of the Prior Art

Various types of sound muffling devices are well known in the art. Such conventional devices include a separate sound reducing element such as, for example, a meander bending pipe, aperture series, serpentine passages, sound attenuating panels, and a gabion containing a wire cage filled with sound absorbing material and ballast material as shown in U.S. Pat. No. 3,461,683 to Valbjorn et al, U.S. Pat. No. 3,656,576 to Gubela, U.S. Pat. No. 4,032,310 to Ignoffo, U.S. Pat. No. 4,050,913 to Roach, U.S. Pat. No. 4,111,081 to Hilliard et al, and U.S. Pat. No. 4,643,271 to Coburn. However, these conventional sound muffling devices suffer from a number of problems such as for example, (1) they cannot achieve a higher noise abating efficiency, (2) they are complicated in construction and expensive to manufacture, and (3) it is difficult install them on the lawnmowers or motor vehicles.

SUMMARY OF THE INVENTION

Accordingly, it is an object of the present invention to provide an improved sound muffling device for use in lawnmowers.

Another object of the present invention is to provide an exhaust sound absorbing unit comprising an adapter having a sound inlet, a hollow shell adapted for a flow of exhaust sound therethrough so as to provide a low level exhaust sound, and a sound outlet.

A further object of the present invention is to provide a sound reducing device comprising a banana shaped hollow shell for use in a lawnmower, and a straight hollow shell for use in a motor vehicle.

Still another object of the present invention is to provide a sound muffling device for lawnmowers, which is simple in construction, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a sound muffling device for use in lawnmowers which includes a hollow body containing an aperture plate, a plurality of serpentine configured pipes, a plurality of fans, a double net having a bundle of wires, a microporous plate, an adaptor having a sound inlet disposed on the exterior of the front end of the hollow body, and a sound outlet of the exterior of a rear end of the hollow body.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Referring now in detail to the drawings for the purpose of illustrating preferred embodiments of the present invention, the sound muffling device for internal combustion engines as shown in FIGS. 1, 2, 3, 4, and 5 comprises a hollow body 11, a sound inlet 12 attached to the exterior of one end of the hollow body 11 and connected to an adaptor 13, and a sound outlet 14 attached to the exterior of the other end of the hollow body 11.

Figure 4:
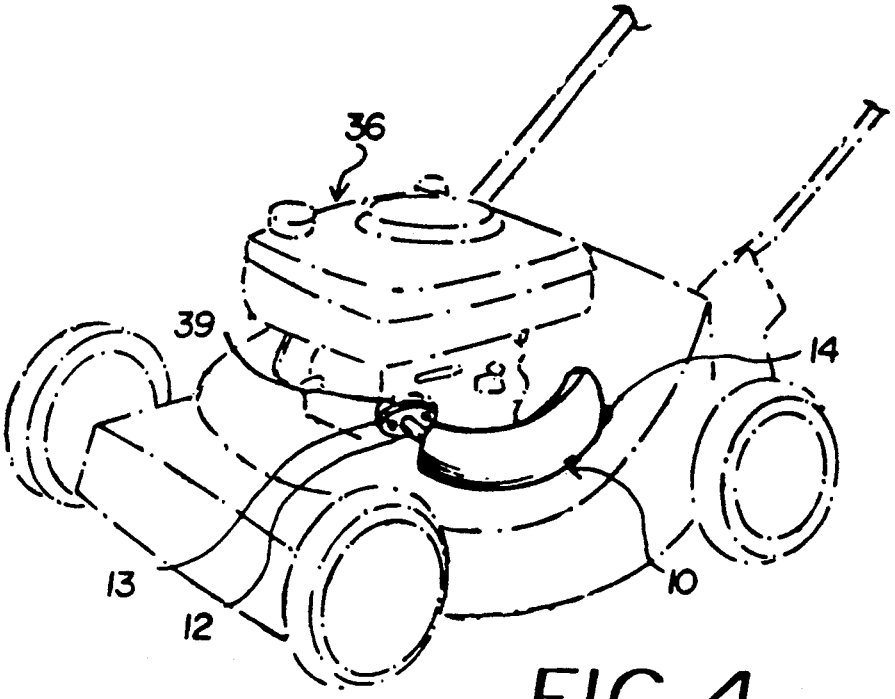
FIG. 4 is a perspective view of the banana shaped sound muffling device according to the present invention, used in a lawnmower.
Figure 5:
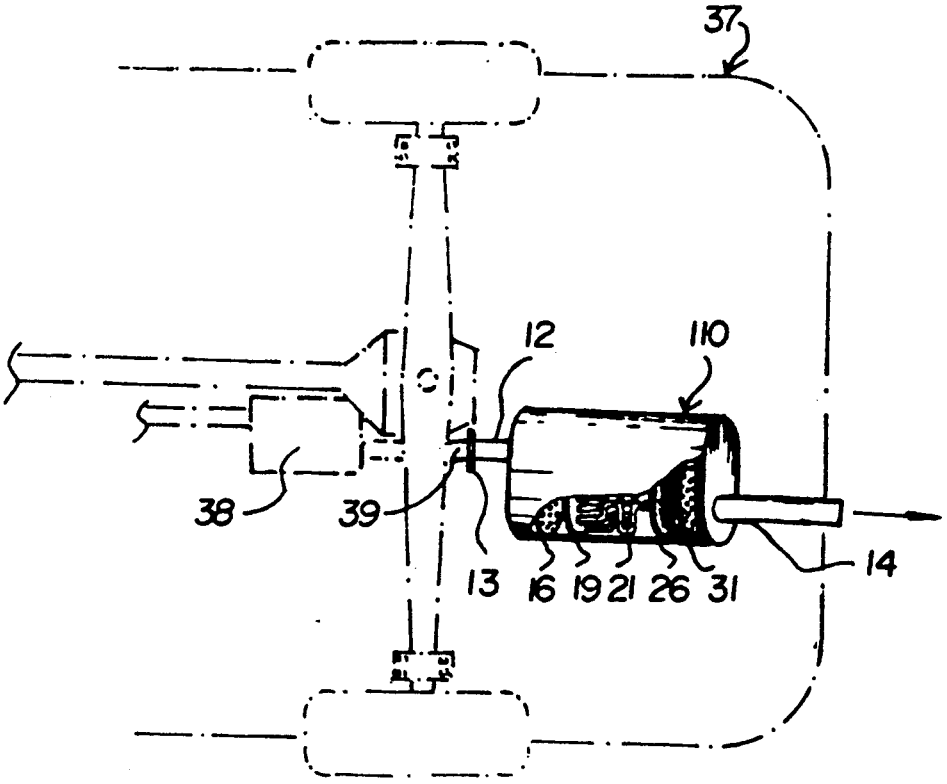
FIG. 5 is a perspective view of the straight sound muffling device according to the present invention, used in a motor vehicle.

The hollow body 11 has a banana shaped configuration for use in a lawnmower 36 so as to match the exterior structure of the lawnmower 36 as shown in FIG. 4, and a straight configuration for use in a motor vehicle 37 in order to be attached to a conventional muffler 38 of the motor vehicle 37 as shown in FIG. 5.

Figure 1:
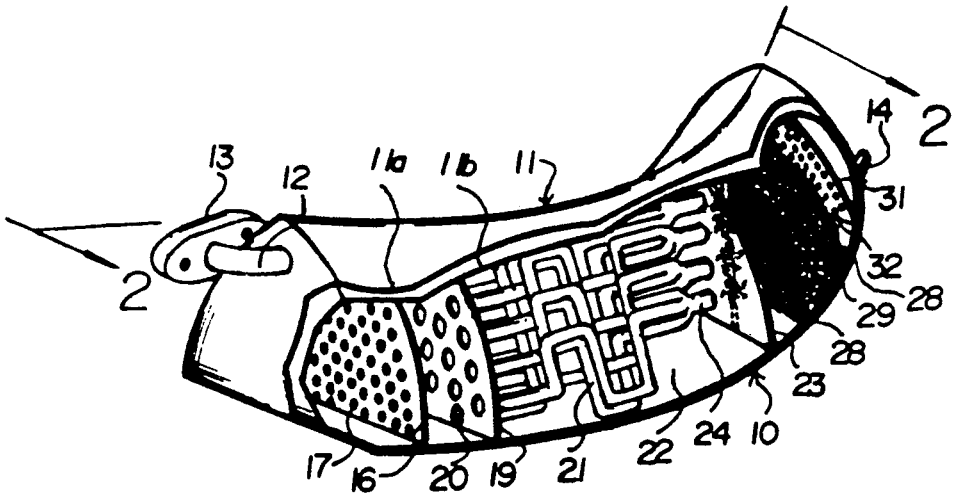
FIG. 1 is a perspective view of the sound muffling device containing cut away portions in order to illustrate the construction of the device according to the present invention.
Figure 2:
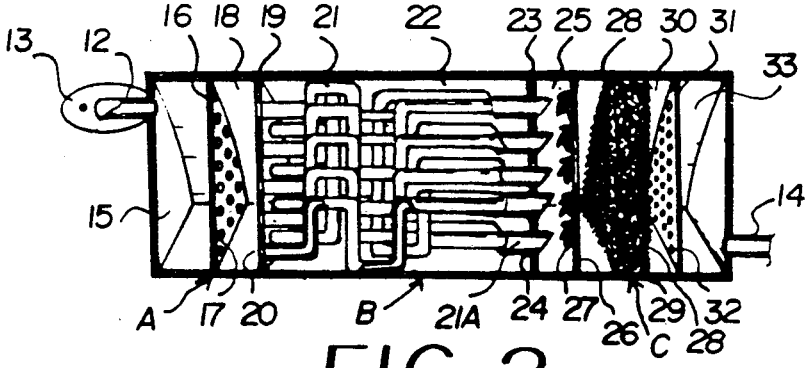
FIG. 2 is a sectional view of FIG. 1, taken along line 2—2.

As shown in FIGS. 1 and 2, the hollow body 11 includes an exterior shell **11*a* and an interior shell 11*b* for forming a double wall so as to reduce sound. The hollow body 11** is segmented into parts: an upstream chamber A, a middle chamber B, and a downstream chamber C.

The upstream chamber A is divided into a first chamber 15 and a second chamber 18 by a first partition plate 16. The first partition has a plurality of apertures 17 for scattering and reducing noisy sound from the sound inlet 12 passing through the first chamber 15 into the second chamber 18.

The middle chamber B defines a vacuum chamber 22 and includes a plurality of serpentine configured bending pipes 21 for effectively reducing the traveled sound from the chamber A because the noisy sound clashes against bending portions of the serpentine configured pipes 21. The serpentine configured bending pipes 21 numbering about twenty are inserted into a plurality of holes 20 of a second partition plate 19 at one end thereof and a plurality of holes 24 of a third partition plate 23 at the other end thereof. At this time, about four serpentine configured bending pipes 21 combine into a tail pipe **21*a* so that five tail pipes 21*a* are inserted into the five holes 24 of the third partition plate 23. Also, the holes 20 of the second partition plate 19 numbers match the twenty serpentine configured bending pipes 21**.

The downstream chamber C is divided into a third chamber 25, a fourth chamber 30, and a fifth chamber 33 by a double net partition 28 and a fourth partition plate 31, respectively. Five fans 27 supported on a fan support 26 are disposed in the third chamber 25 for corresponding to five tail pipes 21*a* so that the traveled sound from the tail pipes 21*a* is scattered by the fans 27 to be delivered to the double net 28. The double net 28 includes a bundle of wires for absorbing the traveled sound as well as purifying exhaust gases. The fourth partition plate 31 contains a plurality of micropores 32 for lastly absorbing the traveling sound so that the fifth chamber 33 has a very low level exhaust sound to be delivered to the sound outlet 14.

Figure 3:
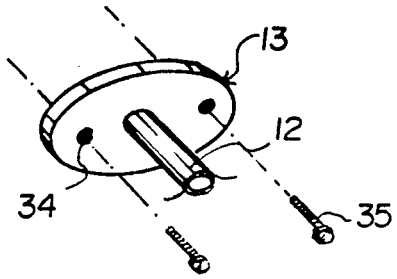
FIG. 3 is a perspective view of an adaptor which attaches to the exterior of a hollow shell unit according to the present invention.

As shown in FIG. 3, the adaptor 13 connected to the sound inlet 12 contains a plurality of adaptor apertures 34 and is provided with a plurality of bolts for attaching the adaptor thus the sound muffling device 10 to the exhaust gas unit 39 of the lawnmower 34 and the muffler 38 of the motor vehicle 35, respectively (FIGS. 4 and 5).

Accordingly, the sound muffling device 10 according to the present invention provides not only exhaust sound absorption but also exhaust gas purification for use in the internal combustion engines.

The sound muffling device 10 of the present invention attached to a lawnmower, MURRAY AEROVAC ®, reduced noisy sound about 85% of the original noisy sound as follows (Table 1):

TABLE 1

| Diameter from the Lawnmower | Original noisy sound | After using the device of the present invention |
|---|---|---|
| 3 feet | 94-101 db | 15-20 db |
| 6 feet | 89-96 db | 13-14 db |
| 13 feet | 82-89 db | 12-13 db |
| 80 feet | 61-68 db | 9-10 db |
| 307 feet | 59-60 db | 9 db |

wherein the data was measured by CAT NO. 33-2050, RADIO SHACK, a division of Tandy Corporation, Fort Worth, Texas 76102.

Generally, one decibel (db) is the smallest difference between sounds detectable by a human ear where 120 decibels of sound would be painful. In addition, the following sound sources generally have the following decibels:

| sound sources | decibels |
|---|---|
| a light whisper | 10 |
| quiet conversation | 20 |
| normal conversation | 30 |
| light traffic | 40 |
| typewriter, loud conversation | -50 |
| noisy office | 60 |
| normal traffic, quiet train | 70 |
| rock music, subway | 80 |
| heavy traffic, thunder | 90 |
| jet plane at takeoff | 100 |

-continued

| sound sources | decibels |
|---|---|
| (The World Almanac, 303, 1991) | |

The invention being thus described, it will be obvious that the same may be varied in many ways. Such variations are not to be regarded as a departure form the spirit and scope of the invention, and all such modifications as would be obvious to one skilled in the art are intended to be included in the scope of the following claims.

What is claimed is:

1. A sound muffling device for use in lawnmowers, which comprises:

an adapter having a sound inlet, a sound outlet, and a hollow body having a first end and a second end, said first end being provided with said sound inlet and said sound outlet being attached to said second end thereof, said hollow body being segmented into an upstream chamber, a middle chamber, and a downstream chamber, said upstream chamber including:

a first partition plate disposed in a center portion of said upstream chamber and having a plurality of apertures for scattering and reducing noisy sound, said middle chamber including:

a plurality of serpentine, configured pipes for effectively absorbing said sound, front ends of said serpentine configured pipes fixed to a plurality of first holes of a first hole support plate and rear ends of said serpentine configured pipes combined to a plurality of tail pipes for slidably inserting into a plurality of second holes of a second hole support plate, and said downstream chamber including:

a plurality of fans supported on a fan support disposed in a front portion thereof corresponding with said plurality of tail pipes so as to scatter and reduce said sound, a double net including a bundle of wires for effectively absorbing said sound and purifying exhaust gases, said double net disposed in a middle portion thereof, and a second partition plate disposed in a rear portion thereof and having a plurality of micropores for lastly absorbing said noisy sound, whereby the sound muffling device can achieve a higher noise abating efficiency.

2. The sound muffling device of claim 1, wherein said plurality of serpentine configured pipes number about 20.

3. The sound muffling device of claim 1, wherein said plurality of tail pipes number about 5.

4. The sound muffling device of claim 1, wherein said hollow body contains a double wall.

5. The sound muffling device of claim 1, wherein said middle chamber is a vacuum chamber for reducing said noisy sound.

6. The sound muffling device of claim 1, wherein said adaptor contains a plurality of bolt apertures.

* * * * *